US010272553B2

(12) United States Patent
Yang et al.

(10) Patent No.: US 10,272,553 B2
(45) Date of Patent: Apr. 30, 2019

(54) DRIVING TOOL

(71) Applicant: MAKITA CORPORATION, Anjo-shi (JP)

(72) Inventors: Ying Yang, Anjo (JP); Kenya Yanagihara, Anjo (JP)

(73) Assignee: MAKITA CORPORATION, Anjo-Shi (JP)

( * ) Notice: Subject to any disclaimer, the term of this patent is extended or adjusted under 35 U.S.C. 154(b) by 1030 days.

(21) Appl. No.: 14/440,143

(22) PCT Filed: Nov. 1, 2013

(86) PCT No.: PCT/JP2013/079799

§ 371 (c)(1),
(2) Date: May 1, 2015

(87) PCT Pub. No.: WO2014/069648

PCT Pub. Date: May 8, 2014

(65) Prior Publication Data

US 2015/0314432 A1 Nov. 5, 2015

(30) Foreign Application Priority Data

Nov. 5, 2012 (JP) ..... 2012-243442

(51) Int. Cl.

| | |
|---|---|
| ***B25C 1/04*** | (2006.01) |
| ***B25C 1/00*** | (2006.01) |
| ***B25C 1/06*** | (2006.01) |

(52) U.S. Cl.

CPC ..... *B25C 1/008* (2013.01); *B25C 1/04* (2013.01); *B25C 1/06* (2013.01)

(58) Field of Classification Search

CPC ..... B25C 1/008; B25C 1/04; B25C 1/06
See application file for complete search history.

(56) References Cited

U.S. PATENT DOCUMENTS

| | | | |
|---|---|---|---|
| 1,071,387 | A | 8/1913 | Behr |
| 1,829,609 | A | 10/1931 | Robinson |
| 3,552,274 | A | 1/1971 | Bojan et al. |
| 3,602,103 | A | 8/1971 | Powers |
| 3,638,534 | A | 2/1972 | Ramspeck |

(Continued)

FOREIGN PATENT DOCUMENTS

| | | | |
|---|---|---|---|
| JP | S63229274 | A | 9/1988 |
| JP | H01115579 | A | 5/1989 |

(Continued)

OTHER PUBLICATIONS

Notice of Allowance from the United States Patent Office dated Oct. 12, 2017 in related U.S. Appl. No. 14/391,263.

(Continued)

*Primary Examiner* — Andrew M Tecco
(74) *Attorney, Agent, or Firm* — J-TEK Law PLLC; Jeffrey D. Tekanic; Scott T. Wakeman

(57) ABSTRACT

A driving tool, such as a nailer, includes a compression cylinder, a compression piston, an electric motor, a control apparatus, a trigger, a trigger switch, a driver guide, and a contact-arm switch. The control apparatus prevents fasteners, such as nails, from being driven when the controller identifies a state, in which it is likely that a malfunction or mis-operation of the driving tool is occurring.

17 Claims, 9 Drawing Sheets

(56) References Cited

U.S. PATENT DOCUMENTS 3,821,992 A 7/1974 Matsuo
3,824,898 A 7/1974 Pauliukonis
3,878,902 A 4/1975 Matsuo
3,995,703 A 12/1976 Wanner
4,344,555 A 8/1982 Wolfberg
5,193,730 A 3/1993 Tanaka et al.
5,440,215 A 8/1995 Gilmore
5,605,268 A 2/1997 Hayashi et al.
5,772,096 A * 6/1998 Osuka ..... B25C 1/008 227/130
6,499,643 B1 12/2002 Hewitt
6,505,767 B2 1/2003 Thieleke et al.
6,604,666 B1 8/2003 Pedicini et al.
6,705,503 B1 3/2004 Pedicini et al.
6,755,336 B2 6/2004 Harper et al.
6,971,567 B1 12/2005 Cannaliato et al.
7,419,079 B2 9/2008 Chen et al.
7,793,811 B1 * 9/2010 Pedicini ..... B25C 1/047 227/130
8,079,504 B1 12/2011 Pedicini et al.
8,167,183 B2 * 5/2012 Matsunaga ..... B25C 1/008 227/117
8,215,528 B2 * 7/2012 Matsunaga ..... B25C 1/08 227/10
8,453,901 B2 * 6/2013 Suda ..... B25C 1/06 227/117
8,622,271 B2 * 1/2014 Shima ..... B25C 1/06 227/2
8,960,516 B2 2/2015 Iijima et al.
9,276,509 B2 3/2016 Kato et al.
9,438,141 B2 9/2016 Ishikawa et al.
9,543,871 B2 1/2017 Kato
9,555,530 B2 1/2017 Pedicini et al.
2004/0217727 A1 11/2004 Gilmore
2004/0232194 A1 11/2004 Pedicini et al.
2005/0001004 A1 1/2005 Fujisawa et al.
2005/0023017 A1 2/2005 Sakai
2005/0217874 A1 10/2005 Forster et al.
2005/0219785 A1 10/2005 Gorti et al.
2007/0045377 A1 * 3/2007 Towfighi ..... B25C 1/04 227/130
2007/0056934 A1 3/2007 Hsu
2007/0138230 A1 6/2007 Gschwend et al.
2008/0017689 A1 1/2008 Simonelli et al.
2008/0073405 A1 * 3/2008 Shima ..... B25C 1/06 227/131
2008/0190988 A1 * 8/2008 Pedicini ..... B25C 1/04 227/130
2008/0217372 A1 9/2008 Webb
2008/0223894 A1 * 9/2008 Cruise ..... B25C 1/008 227/2
2009/0090762 A1 * 4/2009 Leimbach ..... B25C 1/047 227/130
2009/0108046 A1 4/2009 Huang
2009/0184148 A1 * 7/2009 Dittrich ..... B25C 1/08 227/9
2009/0250500 A1 10/2009 Brendel et al.
2009/0321492 A1 * 12/2009 Shima ..... B25C 1/008 227/2
2010/0116863 A1 * 5/2010 Suda ..... B25C 1/008 227/8
2010/0213235 A1 8/2010 Pedicini et al.
2010/0236802 A1 9/2010 Berger et al.
2010/0237124 A1 9/2010 Shima et al.
2010/0237126 A1 * 9/2010 Matsunaga ..... B25C 1/008 227/8
2010/0294824 A1 11/2010 Takemura et al.
2010/0301091 A1 12/2010 Liang et al.
2011/0057014 A1 3/2011 Yang et al.
2011/0108600 A1 * 5/2011 Pedicini ..... B25C 1/047 227/2
2011/0114692 A1 5/2011 Liang et al.
2011/0132959 A1 6/2011 Hlinka et al.
2011/0155403 A1 6/2011 Rohrer
2011/0240709 A1 10/2011 Oouchi
2011/0273117 A1 11/2011 Nakamura et al.
2012/0019177 A1 1/2012 Kaufmann et al.
2012/0187178 A1 7/2012 Campbell
2012/0286014 A1 11/2012 Pedicini et al.
2013/0269961 A1 10/2013 Lim et al.
2014/0054350 A1 2/2014 Pedicini
2014/0158740 A1 6/2014 Akutsu et al.
2014/0318363 A1 10/2014 Bennett
2014/0374461 A1 12/2014 Pedicini et al.
2015/0122868 A1 5/2015 Campbell
2015/0129630 A1 5/2015 Matsuno
2015/0158160 A1 6/2015 Kato
2015/0174748 A1 6/2015 Furuta et al.
2015/0217436 A1 8/2015 Yanagihara et al.
2015/0298308 A1 10/2015 Kato
2015/0314432 A1 11/2015 Yang et al.
2015/0336249 A1 11/2015 Iwata et al.
2016/0079887 A1 3/2016 Takano et al.
2016/0144497 A1 5/2016 Boehm et al.
2017/0001291 A1 1/2017 Schnell et al.
2017/0217004 A1 8/2017 Kato

FOREIGN PATENT DOCUMENTS

JP H0270980 U 5/1990
JP H0396751 A 4/1991
JP H666967 U 9/1994
JP H08276375 A 10/1996
JP 200417206 A 1/2004
JP 2004017206 A 1/2004
JP 2005028568 A 2/2005
JP 2008062360 A 3/2008
JP 2008068353 A 3/2008
JP 2009006446 A 1/2009
JP 200990384 A 4/2009
JP 2009172762 A 8/2009
JP 2009184075 A 8/2009
JP 20105776 A 1/2010
JP 2010173044 A 8/2010
JP WO 2011010511 A1 * 1/2011 ..... B25C 1/008
JP 2011025362 A 2/2011
JP 2011025363 A 2/2011
JP 2011056613 A 3/2011
JP 2012148346 A 8/2012
JP 2012518553 A 8/2012
JP 2013233608 A 11/2013
JP 2014083601 5/2014
WO 2011010511 A1 1/2011
WO 2013168718 A1 11/2013
WO 2014061807 A1 4/2014

OTHER PUBLICATIONS

Office Action from the United States Patent Office dated May 22, 2018 in related U.S. Appl. No. 14/685,783 and examined claims 1-22.

Decision of Final Rejection (Office Action) from the Japanese Patent Office dated May 31, 2016 in related Japanese application No. 2012-243442, and translation of substantive portions thereof.

Final Office Action from the United States Patent Office dated Jun. 26, 2017 in related U.S. Appl. No. 14/391,263, including examined claims 1-20.

Non-final Office Action from the United States Patent Office dated May 15, 2017 in related U.S. Appl. No. 14/391,283, including examined claims 1-12 and 14-21.

Non-final Office Action dated Sep. 5, 2017 in related U.S. Appl. No. 14/565,993, including examined claims 1-19.

Office Action dated Feb. 27, 2017 in related U.S. Appl. No. 14/391,263 and examined claims 1-20.

Office Action from the German Patent Office dated Nov. 10, 2017 in related German application No. 10 2013 005 280.6, and translation thereof.

Office Action from the Japanese Patent Office dated Jun. 2, 2015 in related Japanese application No. 2012-088842, and translation of substantive portions thereof.

(56) References Cited

OTHER PUBLICATIONS

Office Action from the Japanese Patent Office dated Jun. 2, 2015 in related Japanese application No. 2012-088843, and translation of substantive portions thereof.
Office Action from the Japanese Patent Office dated Aug. 16, 2017 in related Japanese application No. 2014-084678, and translation of substantive portions thereof.
Office Action from the Japanese Patent Office dated Sep. 21, 2017 in related Japanese application No. 2012-243442, and translation thereof.
English translation of International Search Report for parent application No. PCT/JP2013/079799.
English translation of Written Opinion for parent application No. PCT/JP2013/079799.
Unpublished U.S. Appl. No. 14/399,647.
Unpublished U.S. Appl. No. 14/565,993.
Unpublished U.S. Appl. No. 14/685,783.
Office Action dated Oct. 2, 2017 in related U.S. Appl. No. 14/399,647.
Office Action from the Japanese Patent Office dated Feb. 3, 2016 in counterpart Japanese application No. 2012-243442, and translation of substantive portions thereof.
Office Action from the Japanese Patent Office dated Apr. 18, 2018 in related Japanese application No. 2012-243442, and translation of portions thereof concerning differences from the prior art and reasons for combining references.
Office Action from the Japanese Patent Office dated Jun. 27, 2018 in Trial Appeal No. 2016-12921 of counterpart JP application No. 2012-243442, and English translation of portions thereof.

* cited by examiner

DRIVING TOOL

CROSS-REFERENCE

This application is the US national stage of International Patent Application No. PCT/JP2013/079799 filed on Nov. 1, 2013, which claims priority to Japanese Patent Application No. 2012-243442 filed on Nov. 5, 2012.

TECHNICAL FIELD

The present invention generally relates to a driving (power) tool that drives a driven article, such as a fastener, into a workpiece.

BACKGROUND ART

A driving tool that drives a driven article (fastener) into a workpiece is described in U.S. Pat. No. 8,079,504. In this driving tool, compressed air generated by a first piston inside a first cylinder is supplied to a second cylinder. Furthermore, the compressed air moves a second piston within the second cylinder. When the second piston moves, the second piston strikes the driven article and thereby drives it toward the workpiece. In this driving tool, the drive of a motor is controlled by switching a switch ON and OFF.

SUMMARY OF THE INVENTION

However, in the above-described driving tool, there is a possibility that the driving tool might operate incorrectly (malfunction) if the switch malfunctions. That is, it is possible that a driven article (fastener) might be driven out contrary to the intention of the operator.

Accordingly, an object of the present teachings is to provide one or more improved techniques to improve the safety of a driving tool.

In one aspect of the present teachings, a driving tool preferably comprises: a cylinder; a piston capable of sliding within the cylinder; a motor that drives the piston; a controller that controls the motor; a first movable member that, based on a user operation performed when the user drives the driven article, makes contact with a workpiece and thereby is moved from a first position to a second position; a first switch configured such that it is in an OFF state if the first movable member is positioned at the first position and in an ON state if the first movable member is positioned at the second position; a second movable member that is operated by the user when the user drives the driven article and thereby is moved from the third position to the fourth position; and a second switch configured such that it is in the OFF state if the second movable member is positioned at the third position and in the ON state if the second movable member is positioned at the fourth position. In this driving tool, a battery for supplying electric current to the motor is configured such that the battery is attachable and detachable. The controller, if both the first switch and the second switch change to the ON state, generates an air pressure change inside the cylinder by driving the motor and the driven article is thereby driven as a result of the pressure change. The controller inhibits (prevents) the driving of the driven article in at least one case from among: the case in which it is detected that the first switch is in the ON state when the first movable member is positioned at the first position; the case in which it is detected that the second switch is in the ON state when the second movable member is positioned at the third position, the case in which it is detected that the first switch is in the ON state continuously for a prescribed time when the first movable member is positioned at the second position; and the case in which it is detected that the second switch is in the ON state continuously for a prescribed time when the second movable member is positioned at the fourth position. For example, the first movable member may be configured as a contact arm that, based on a user operation, makes contact with the workpiece and thereby is moved; and the second movable member may be configured as a trigger that is directly operated by a finger of the user.

According to another aspect of the present teachings, the controller inhibits (prevents) the driving of the driven article in the case in which it is detected that the first switch is in the ON state when the first movable member is positioned at the first position or in the case in which it is detected that the second switch is in the ON state when the second movable member is positioned at the third position.

Because the first switch is configured to change to the OFF state when the first movable member is positioned at the first position, it is understood that the first switch is not operating normally in case it is in the ON state while the first movable member is positioned at the first position. Likewise, because the second switch is configured to change to the OFF state when the second movable member is positioned at the third position, it is understood that the second switch is not operating normally in case it is in the ON state while the second movable member is positioned at the third position. Therefore, in embodiments according to this aspect, the controller inhibits (prevents) the driving of driven articles when either of these abnormal states is detected and thereby driven articles are prevented from being unintentionally driven. That is, if a malfunction occurs in any of the first switch, the second switch, the member that actuates the first switch, the member that actuates the second switch, etc., then driven articles are prevented from being driven. As a result, the first switch and the second switch also function, in effect, as a safety apparatus.

According to another aspect of the driving tool according to the present teachings, the battery is configured to be attachable to and detachable from the driving tool. Furthermore, at the time that the battery is mounted, the controller inhibits (prevents) the driving of the driven article when at least one of the first switch and the second switch is detected in the ON state.

According to this aspect, when the user is mounting the battery onto the driving tool, the user is normally not (simultaneously) performing the operation for driving a driven article. Therefore, if it determined that at least one of the first switch and the second switch is in the ON state when the battery is being mounted, then it is determined that there is a malfunction in the first switch, the second switch, or the like. Consequently, the controller inhibits (prevents) the subsequent driving of driven articles and thereby, in the state in which the first switch, the second switch, or the like is malfunctioning, the driving tool is prevented from unintentionally driving any driven articles (fasteners). In addition, when the battery is mounted, it is possible to check whether a malfunction is occurring in the first switch, the second switch, or the like.

According to another aspect of the present teachings, the driving tool comprises: a change-over switch that switches between an electric-current-supply permitted state that permits the supply of electric current from the battery to the controller and an electric-current-supply cutoff state that cuts off the supply of electric current. Furthermore, the controller inhibits (prevents) the driving of the driven article if it is detected that at least one of the first switch and the second switch is in the ON state when the change-over switch is switched from the electric-current-supply cutoff state to the electric-current-supply permitted state. The change-over switch is typically configured as a main (power) switch that starts up the driving tool.

According to this aspect, when switching the change-over switch, the user is normally not performing the operation for driving a driven article. Therefore, if at least one of the first switch and the second switch is in the ON state when the change-over switch is switched from the electric-current-supply cutoff state to the electric-current-supply permitted state, then it is determined that there is a malfunction in the first switch, the second switch, or the like. Consequently, the controller inhibits (prevents) the subsequent driving of driven articles and thereby, in the state in which the first switch, the second switch, or the like is malfunctioning, the driving tool is prevented from unintentionally driving any driven articles. In addition, when the change-over switch is switched, it is possible to check whether a malfunction is occurring in the first switch, the second switch, or the like.

According to another aspect of the present teachings, the controller inhibits (prevents) the driving of the driven article if it is detected that the first switch is in the ON state continuously for the prescribed time when the first movable member is positioned at the second position or if it is detected that the second switch is in the ON state continuously for the prescribed time when the second movable member is positioned at the fourth position.

If either of the switches is in the ON state continuously for a prescribed time, then there is a possibility that the driven article will be unintentionally driven not only in the case in which a malfunction is occurring in the first switch, the second switch, or the like, but also in the case in which the first switch and the second switch are operating normally. Therefore, according to the present aspect, if either of the switches is in the ON state continuously for a prescribed time, the driving of driven articles is inhibited (prevents) and thereby driven articles can be prevented from being driven unintentionally. Furthermore, "the switch is in the ON state continuously for a prescribed time" preferably includes, for example, the case in which a switch fails, the case in which a member that actuates a switch fails, the case in which the user operates the driving tool improperly, and the like.

According to another aspect of the present teachings, the controller permits the subsequent driving of the driven article if it is detected that the first movable member is positioned at the first position and the first switch is in the OFF state and if it is detected that the second movable member is positioned at the third position and the second switch is in the OFF state.

According to this aspect, if it can be confirmed that the first switch and the second switch are operating normally again, then the driving of a driven article is permitted. As a result, the driving tool can be driven in a rational manner.

According to another aspect of the present teachings, the driving tool comprises: an informing means that indicates to the user that the driving of the driven article is being inhibited (prevents) by the controller. A light-emitting means, a vibration-generating means, a sound-generating means, or the like is preferably used as the informing means. An LED, a laser-radiating device, or the like may be used as the light-emitting means. A means that comprises a motor and generates vibrations by the rotation of the motor may be used as the vibration-generating means. In addition, a means that comprises a speaker and outputs a recorded sound source from the speaker may be used as the sound-generating means.

According to this aspect, the user can be informed, via the informing means, that the first switch or the second switch is not operating normally and consequently the controller is inhibiting (preventing) the driving of the driven article.

According to the present teachings, it is possible to provide improved techniques for safely operating a driving tool.

Other features, functions, and effects of the present teachings can be readily understood by referring to the present specification, the claims, and the attached drawings.

DETAILED DESCRIPTION

Figure 1:
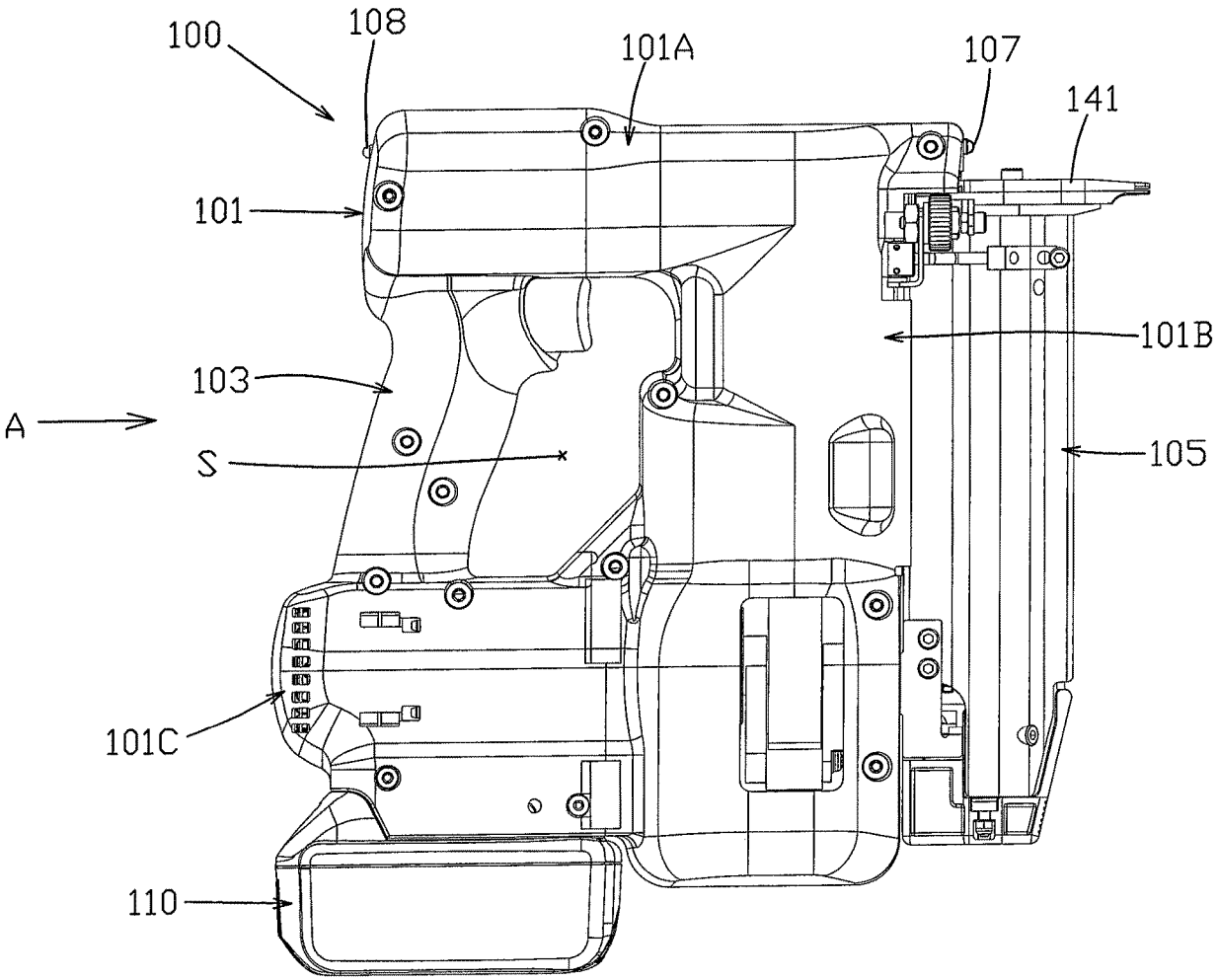
FIG. 1 is an external view that shows the overall configuration of an electro-pneumatic nailer according to the present teachings.
Figure 2:
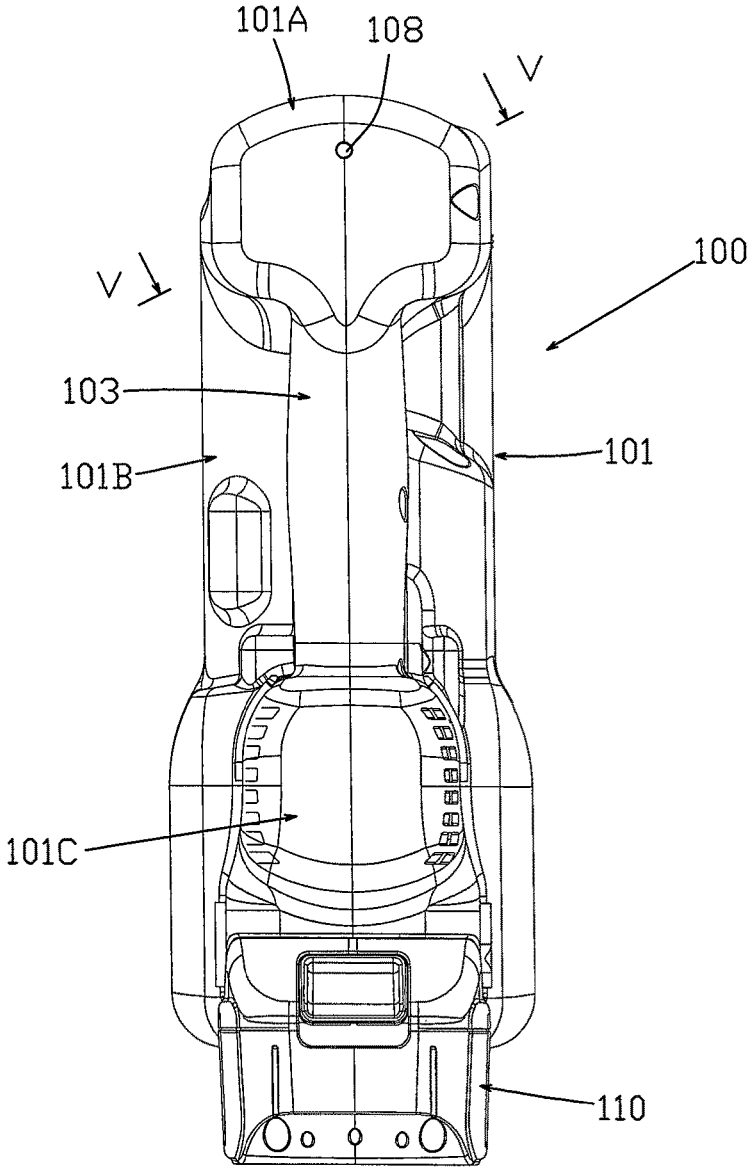
FIG. 2 is a view taken in the direction of arrow A shown in FIG. 1.

The structural elements and methods described above and below may be used separately or in conjunction with other structural elements and methods to manufacture and use driving tools according to the present teachings. Representative embodiments of this invention include these combinations and will be described in detail with reference to the attached drawings. The detailed description below merely teaches a person skilled in the art detailed information for practicing preferred examples of the present invention and does not limit the technical scope of the present invention, which is defined based on the text of the claims. Therefore, combinations of structural elements, method steps, and the like in the detailed explanation below are, in a broad sense, not all essential to practice the invention and instead merely disclose, in the detailed explanation given in conjunction with the reference numerals in the attached drawings, representative aspects of the present invention.

A representative embodiment will be explained below, with reference to FIG. 1 through FIG. 9. The present embodiment is explained using an electro-pneumatic nailer as one example of a driving tool according to the present teachings. As shown in the overall views of FIG. 1 and FIG. 2, a nailer 100 principally comprises a main-body housing 101 and a magazine 105. The main-body housing 101 is configured as a tool main body and forms an outer wall of the nailer 100. The magazine 105 is loaded with nails (not illustrated) to be driven into a workpiece. The main-body housing 101 is formed by joining together a pair of substantially symmetrical housings. The main-body housing 101 comprises a handle part 103, a driving-mechanism-housing part 101A, a compression-apparatus-housing part 101B, and a motor-housing part 101C.

The handle part 103, the driving-mechanism-housing part 101A, the compression-apparatus-housing part 101B, and the motor-housing part 101C are disposed such that they generally form a rectangular shape. The handle part 103 is an elongate member that extends with a prescribed length. One-end side of the handle part 103 is joined to one-end side of the driving-mechanism-housing part 101A and the other-end side of the handle part 103 is joined to one-end side of the motor-housing part 101C. Moreover, the compression-apparatus-housing part 101B is disposed such that it extends substantially parallel to the handle part 103. One-end side of the compression-apparatus-housing part 101B is joined to an other-end side of the driving-mechanism-housing part 101A, and an other-end side of the compression-apparatus-housing part 101B is joined to an other-end side of the motor-housing part 101C. Thereby, in the nailer 100, a (hollow) space S is formed that is surrounded by the handle part 103, the driving-mechanism-housing part 101A, the compression-apparatus-housing part 101B, and the motor-housing part 101C.

As shown in FIG. 1, a driver guide 141 and an LED 107 are disposed at a tip part (the right end in FIG. 1) of the nailer 100. The rightward direction in FIG. 1 is the nail driving direction. Furthermore, for the sake of convenience of explanation, the tip side (the right side in FIG. 1) of the nailer 100 is called the front side, and the side opposite the tip side (the left side in FIG. 1) is called the rear side. In addition, the side of the nailer 100 (the upper side in FIG. 1) to which the driving-mechanism-housing part 101A of the handle part 103 is joined is called the upper side, and the side of the nailer 100 (the lower side in FIG. 1) to which the motor-housing part 101C of the handle part 103 is joined is called the lower side.

Figure 3:
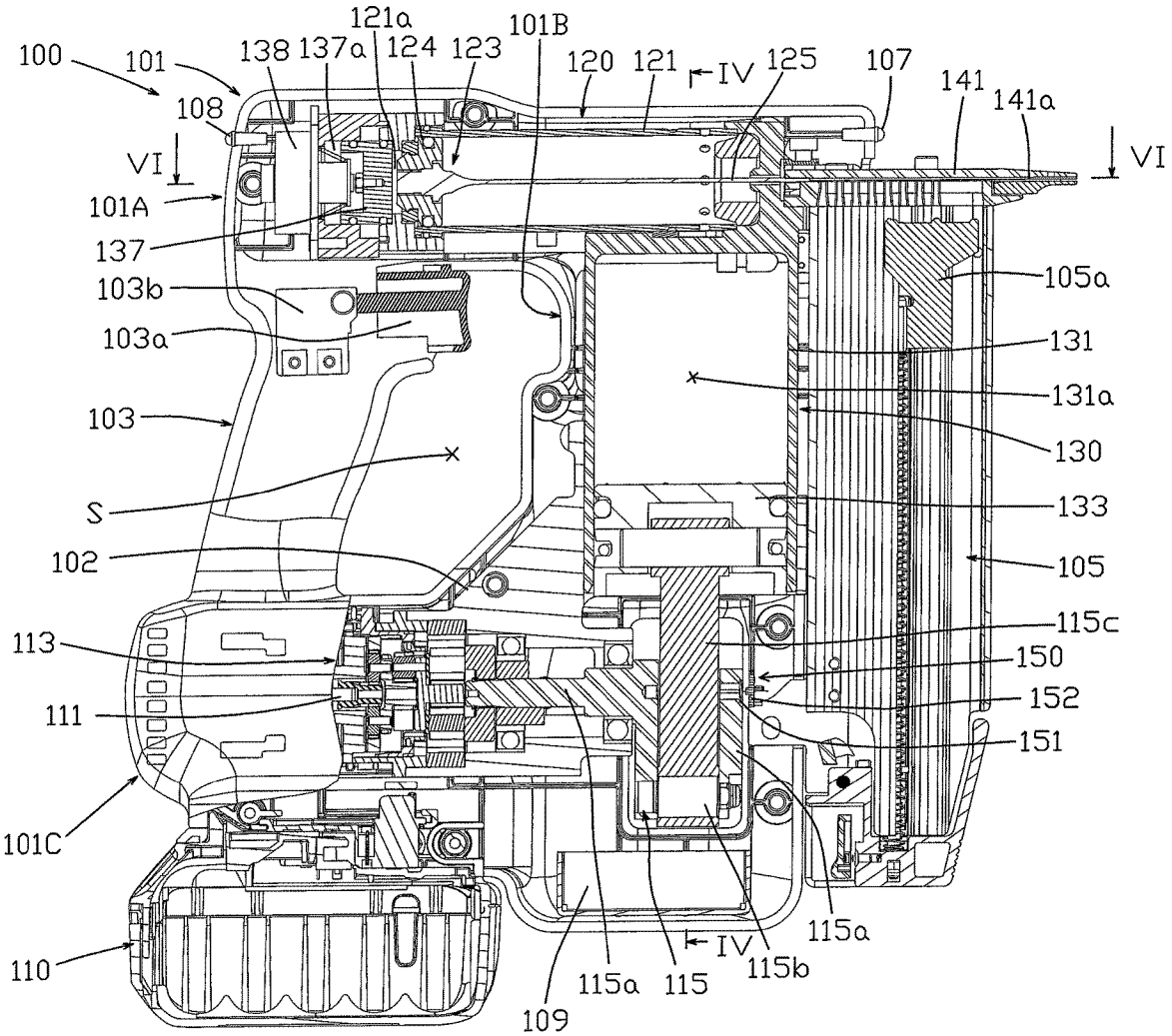
FIG. 3 is a cross sectional view that shows the overall configuration of an internal mechanism of the nailer.

As shown in FIG. 3, the driving-mechanism-housing part 101A houses a nail-driving mechanism 120. The nail-driving mechanism 120 principally comprises a driving cylinder 121 and a driving piston 123.

The driving cylinder 121 houses the driving piston 123 such that the driving piston 123 is capable of sliding in the front-rear directions (the longitudinal-axis direction). The driving piston 123 comprises a piston-main-body part 124 and a driver 125. The driver 125 is an elongate member. The driver 125 is integrally provided with the piston-main-body part 124 and is disposed such that it extends forward. The piston-main-body part 124 and the driver 125 are configured such that they are capable of reciprocally moving along the longitudinal-axis direction of the driving cylinder 121 by supplying compressed air into a cylinder chamber 121*a*. Thereby, the driver 125 moves forward within a driving passage 141*a* of the driver guide 141 and thereby drives a nail. The driving-cylinder chamber 121*a* is formed as a space that is surrounded by an inner wall surface of the driving cylinder 121 and a rear side surface of the piston-main-body part 124. The driver guide 141 is disposed at a tip part of the driving cylinder 121 and has the driving passage 141*a*, which has a nail ejection port at its tip.

As shown in FIG. 1, the magazine 105 is disposed on the tip side of the main-body housing 101, that is, forward of the compression-apparatus-housing part 101B. The magazine 105 houses the nails, which are the driven articles. In addition, the magazine 105 is coupled to the driver guide 141 and supplies the nails to the driving passage 141*a*. Furthermore, as shown in FIG. 3, the magazine 105 is provided with a pusher plate 105*a* for pushing the nails in a supplying direction (upward in FIG. 3). The nails are supplied, one nail at a time, by the pusher plate 105*a* to the driving passage 141*a* of the driver guide 141 from a direction that intersects the driving direction.

As shown in FIG. 3, the compression-apparatus-housing part 101B houses a compression apparatus 130. The compression apparatus 130 principally comprises a compression cylinder 131, a compression piston 133, and a crank mechanism 115. The compression piston 133 is disposed, such that it is capable of sliding in the up-down directions, within the compression cylinder 131. The compression cylinder 131 and the compression piston 133 are example embodiments that correspond to a "cylinder" and a "piston," respectively, in the present teachings.

The compression cylinder 131 is disposed along the magazine 105, and an upper-end side of the compression cylinder 131 is joined to a front-side end part of the driving cylinder 121. Furthermore, the compression piston 133 is disposed such that it slides in the up-down directions along the magazine 105. The operation directions of the compression piston 133 are substantially orthogonal to the operation directions of the driving piston 123. The volume of a compression chamber 131*a*, which is an internal space of the compression cylinder 131, changes owing to the compression piston 133 sliding in the up-down directions. That is, the movement of the compression piston 133 toward the upward side, which reduces the volume of the compression chamber 131*a*, compresses air in the compression chamber 131*a*. The compression chamber 131*a* is formed on an upper-part side that is proximate to the driving cylinder 121. In addition, the compression cylinder 131 comprises an atmosphere open valve (not illustrated) and is configured such that it is capable of opening the compression chamber 131*a* to the atmosphere. The atmosphere open valve is normally held in a closed state.

As shown in FIG. 3, the motor-housing part 101C houses an electric motor 111. The electric motor 111 is disposed such that the rotational axis of the motor shaft is substantially parallel to the longitudinal axis of the driving cylinder 121. Accordingly, the rotational axis of the electric motor 111 is orthogonal to the operation direction of the compression piston 133. Furthermore, a battery-mount area is formed on a lower-part side of the motor-housing part 101C, and a rechargeable battery pack 110 that supplies electric power to the electric motor 111 is attachably and detachably mounted to the battery-mount area. The battery pack 110 is an example embodiment that corresponds to a "battery" in the present teachings.

As shown in FIG. 3, the rotational speed of the electric motor 111 is reduced by a planetary-gear-type, speed-reducing mechanism 113, after which the rotation is transmitted to the crank mechanism 115. Furthermore, the rotation of the electric motor 111 is converted into linear motion by the crank mechanism 115 and then transmitted to the compression piston 133. The speed-reducing mechanism 113 and the crank mechanism 115 are housed in an inner-side housing 102. The inner-side housing 102 is disposed between the compression-apparatus-housing part 101B and the motor-housing part 101C. The electric motor 111 is an example embodiment that corresponds to a "motor" in the present teachings.

As shown in FIG. 3, the crank mechanism 115 principally comprises a crankshaft 115*a*, an eccentric pin 115*b*, and a connecting rod 115*c*. The crankshaft 115*a* is joined to the planetary-gear-type, speed-reducing mechanism 113. That is, the crankshaft 115*a* is rotationally driven by the rotation of the electric motor 111, the speed of which has been reduced by the speed-reducing mechanism 113. The eccentric pin 115*b* is provided at a position that is offset from the center of rotation of the crankshaft 115*a*. One end of the connecting rod 115*c* is pivotally joined to the eccentric pin 115*b*, and the other end of the connecting rod 115*c* is pivotally joined to the compression piston 133. The crank mechanism 115 is disposed below the compression cylinder 131. Based on the above-described configuration, the compression apparatus 130 is configured as a reciprocating-type compression apparatus and principally comprises the compression cylinder 131, the compression piston 133, and the crank mechanism 115.

As shown in FIG. 3, the handle part 103 is provided with a trigger 103*a* and a trigger switch 103*b*. The trigger switch 103*b* transitions to the ON state by the performance of the operation in which the trigger 103*a* is pulled. Moreover, the trigger switch 103*b* transitions to the OFF state by ceasing the pulling operation of the trigger 103*a*. That is, the trigger 103*a* is configured to be movable between the front side (the right side in FIG. 3) position, at which the trigger 103*a* is not being operated by the user, and the rear side (the left side in FIG. 3) position, at which the trigger 103*a* has been operated by the user. Furthermore, when the trigger 103*a* is positioned on the front side, the trigger switch 103*b* is in the OFF state. Moreover, when the trigger 103*a* is positioned on the rear side, the trigger switch 103*b* is in the ON state. The trigger 103*a* and the trigger switch 103*b* are example embodiments that correspond to a "second movable member" and a "second switch," respectively, in the present teachings. In addition, the front-side position and the rear-side position, at which the trigger 103*a* may be positioned, are example embodiments that correspond to a "third position" and a "fourth position," respectively, in the present teachings.

Figure 6:
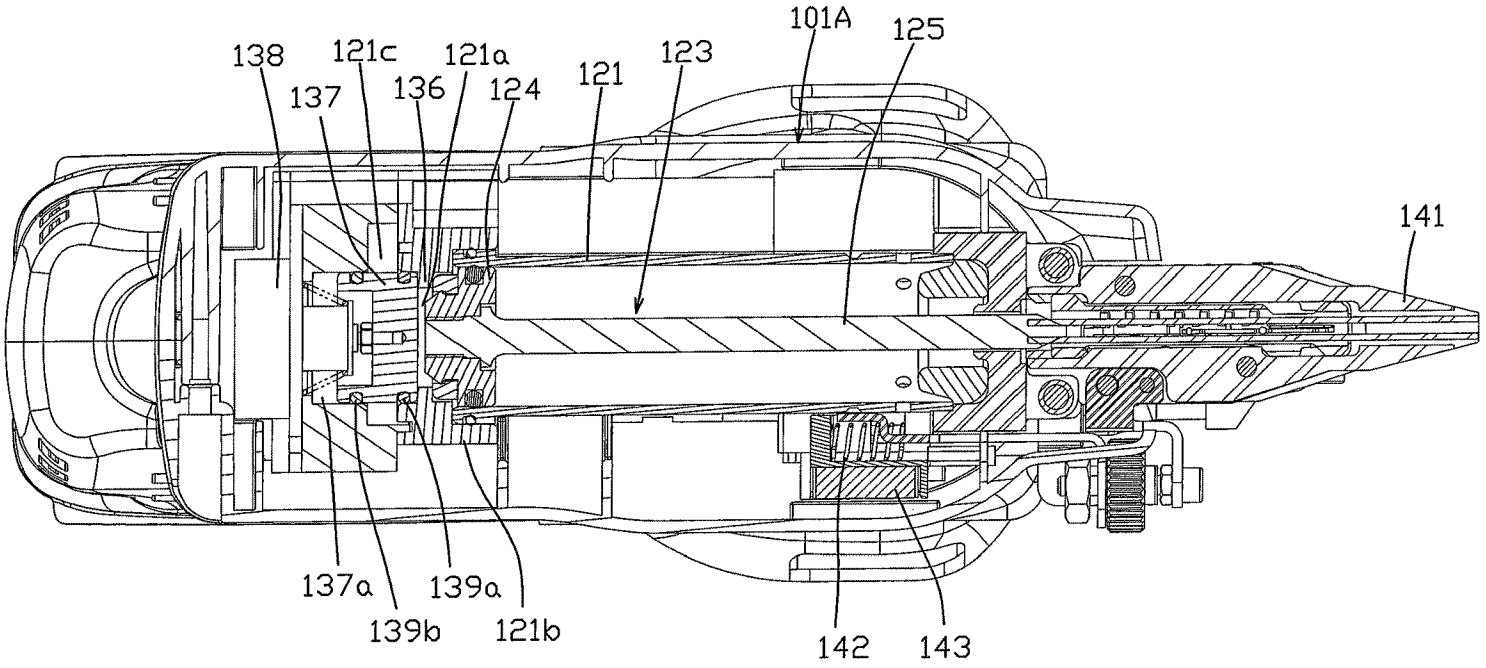
FIG. 6 is a cross sectional view taken along line VI-VI shown in FIG. 3 and shows the state in which a valve is closed.

In addition, the driver guide 141, which serves as a contact arm, is disposed at the tip area of the main-body housing 101 such that it is capable of moving in the front-rear directions of the nailer 100. As shown in FIG. 6, the driver guide 141 is biased forwardly by a biasing spring 142. When the driver guide 141 is positioned forward, a contact-arm switch 143 is in the OFF state. Moreover, when the driver guide 141 is moved towards the side of the main-body housing 101, the contact-arm switch 143 transitions to the ON state. That is, the driver guide 141 is configured to be movable between the forward position and the rearward position, which is on the main-body housing 101 side. The driver guide 141 and the contact-arm switch 143 are example embodiments that correspond to a "first movable member" and a "first switch," respectively, in the present teachings. In addition, the forward position and the rearward position, at which the driver guide 141 may be positioned, are example embodiments that correspond to a "first position" and a "second position," respectively, in the present teachings.

As shown in FIG. 3, a control apparatus 109 is disposed below the crank mechanism 115. Furthermore, the electric motor 111 is configured such that it is controlled by the control apparatus 109 in accordance with the operation of the trigger 103*a*, which is provided on the handle part 103, and the operation of the driver guide 141, which is provided at the tip area of the main-body housing 101. That is, the electric motor 111 is energized and driven when the trigger switch 103*b* and the contact-arm switch 143 are both switched to the ON state, and stops when either the trigger switch 103*b* or the contact-arm switch 143 is switched to the OFF state. The control apparatus 109 is an example embodiment that corresponds to a "controller" in the present teachings.

Figure 4:
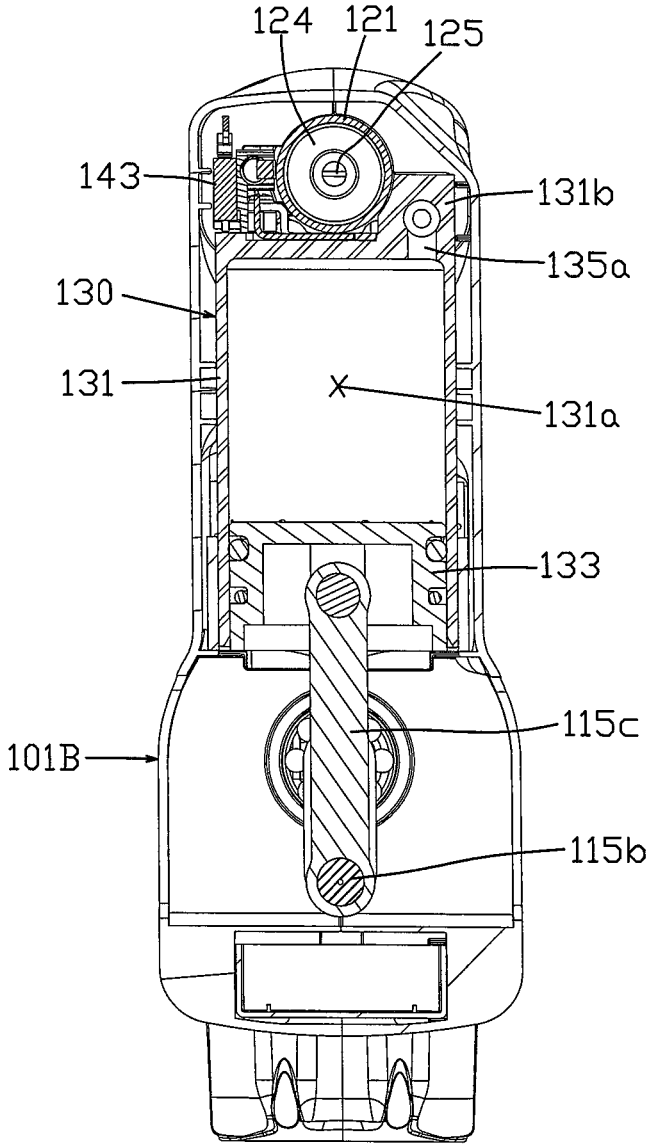
FIG. 4 is a cross sectional view taken along line IV-IV shown in FIG. 3.
Figure 5:
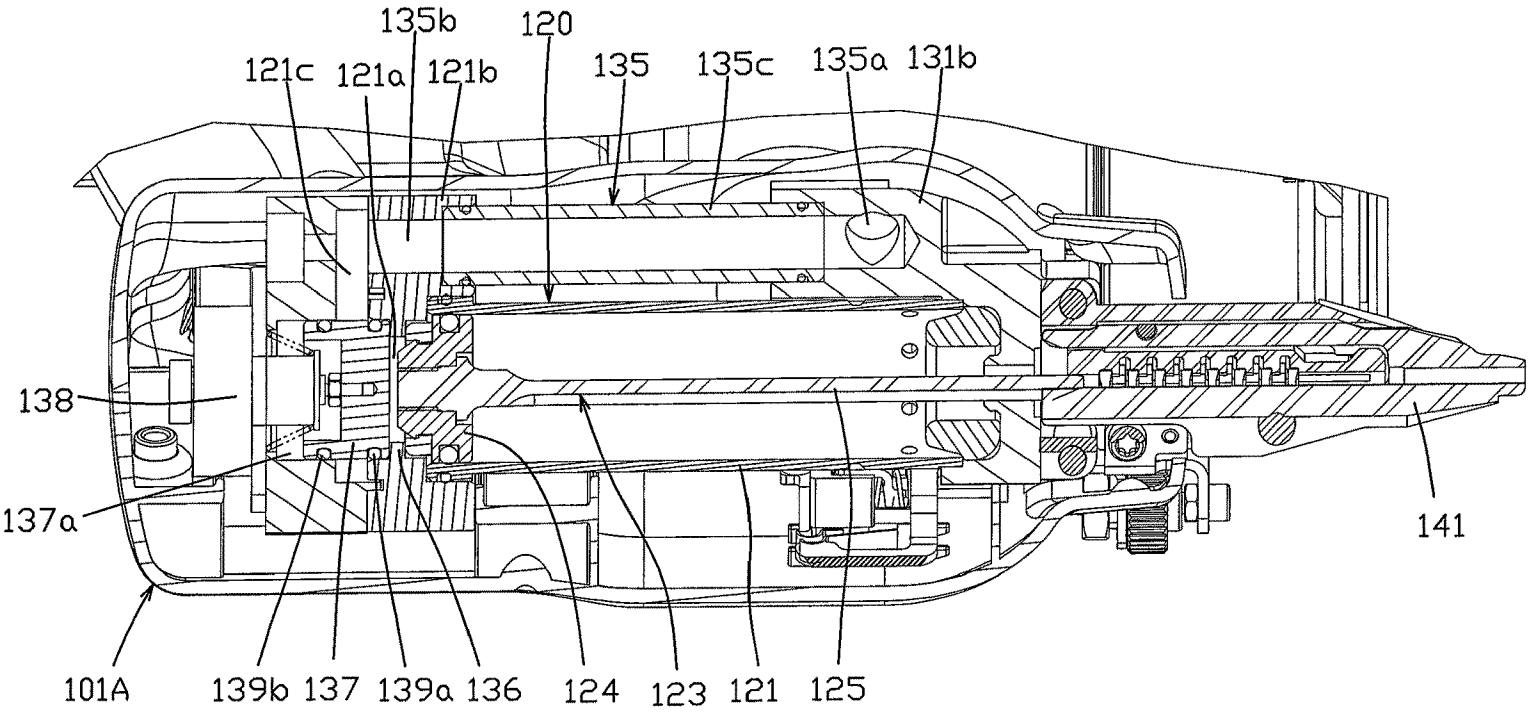
FIG. 5 is a cross sectional view taken along line V-V shown in FIG. 2.

As shown in FIG. 5, the nailer 100 has an air passage 135 and a valve chamber 137*a*, which provide communication between the compression chamber 131*a* of the compression cylinder 131 and the cylinder chamber 121*a* of the driving cylinder 121. The air passage 135 principally comprises a communication port 135*a*, a communication port 135*b*, and a communication path 135*c*; an annular groove 121*c* and the valve chamber 137*a* are in fluid communication therewith. As shown in FIG. 4, the communication port 135*a* is formed in a cylinder head 131*b* of the compression cylinder 131. The communication port 135*a* communicates with the compression chamber 131*a*. In addition, as shown in FIG. 5, the communication port 135*b* is formed in a cylinder head 121*b* of the driving cylinder 121. The communication port 135*b* communicates with the valve chamber 137*a*. The communication path 135*c* provides communication between the communication port 135*a* and the communication port 135*b*. The communication path 135*c* extends linearly in the front-rear direction along the driving cylinder 121.

As shown in FIG. 5, the communication port 135*b* communicates with the annular groove 121*c*, which is formed in a circumferential surface of the valve chamber 137*a*. The annular groove 121*c* communicates with the valve chamber 137*a*. Furthermore, the valve chamber 137*a* communicates with the cylinder chamber 121*a*. Thereby, the communication port 135*b* communicates with the cylinder chamber 121*a* via the annular groove 121*c* and the valve chamber 137*a*. A solenoid valve 137, which opens and closes the air passage 135, is housed in the valve chamber 137*a*.

The solenoid valve 137 is a cylindrical member having a diameter substantially the same as that of the piston-main-body part 124 of the driving piston 123. The solenoid valve 137 is disposed, such that it is capable of moving in the front-rear directions, within the valve chamber 137*a*. An electromagnet 138 is disposed rearward of the solenoid valve 137. Furthermore, the solenoid valve 137 moves in the front-rear directions by switching the supply of power to the electromagnet 13. Two O-rings 139*a*, 139*b* are disposed on the outer circumference of the solenoid valve 137 at a prescribed spacing in the front-rear direction. The solenoid valve 137 opens and closes the annular groove 121*c* by moving rearward and forward, respectively.

Figure 7:
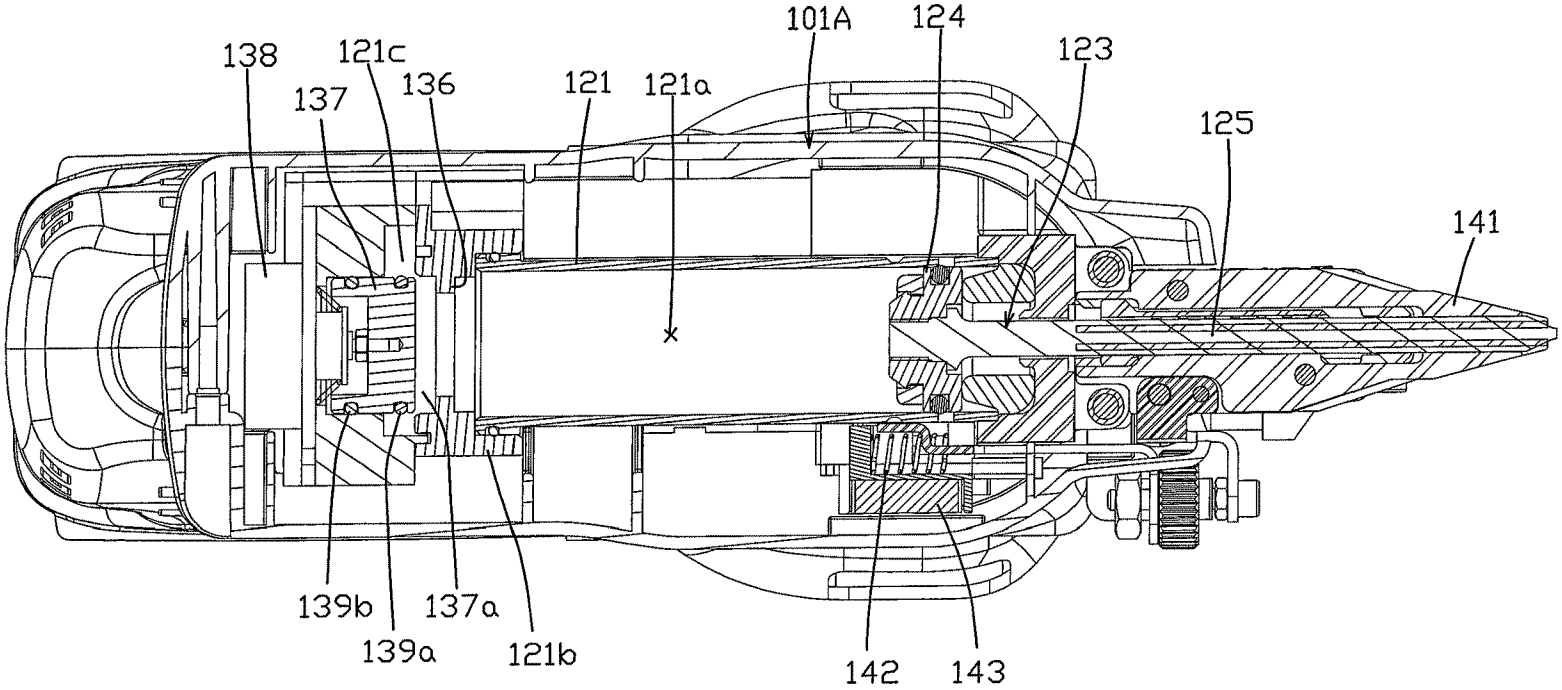
FIG. 7 shows a nailing state in which the valve in FIG. 6 has opened and the driving piston has moved forward.

Specifically, as shown in FIG. 6, the O-ring 139*a*, which is on the front side, blocks the communication between the annular groove 121*c* and the cylinder chamber 121*a* by contacting the inner-wall surface of the valve chamber 137*a* forward of the annular groove 121*c*. In addition, as shown in FIG. 7, when the O-ring 139*a* moves into the region of the annular groove 121*c*, the annular groove 121*c* communicates with the cylinder chamber 121*a*. Furthermore, the O-ring 139*b*, which is on the rear side, prevents the compressed air from leaking out of the communication port 135*b* to the outer side. That is, the O-ring 139*b* does not contribute to the opening and closing of the annular groove 121*c*. Thus, the solenoid valve 137, which opens and closes the air passage 135, is provided on the side of the air passage 135 on which the cylinder chamber 121*a* of the driving cylinder 121 is connected.

As shown in FIG. 6, the solenoid valve 137 is disposed forward by the electromagnet 138 such that the annular groove 121*c* is normally closed. In addition, a stopper 136 is disposed forward of the solenoid valve 137 and limits the forward movement of the solenoid valve 137. The stopper 136 is formed by a flange-shaped member that protrudes in the radial direction inside the cylinder chamber 121*a*. Furthermore, the stopper 136 defines a rear-end position of the rearward movement of the driving piston 123.

Figure 9:
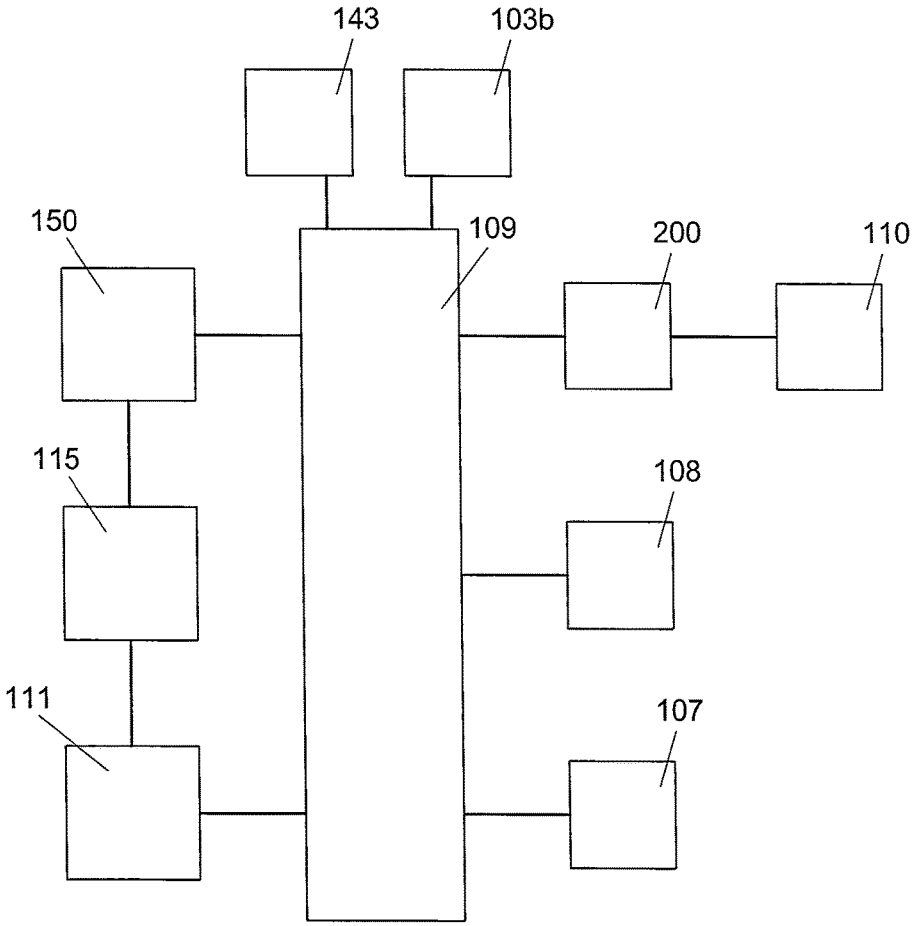
FIG. 9 is a block diagram that shows a control system of the nailer.

Next, the operation of the nailer 100 will be explained. As shown in FIG. 9, the nailer 100 comprises a main (power) switch 200, which is connected to the control apparatus 109. When the main switch 200 is in the ON state, electric current is supplied from the battery pack 110 to the electric motor 111 via the control apparatus 109. On the other hand, when the main switch 200 is in the OFF state, the supply of electric current from the battery pack 110 is cut off. That is, the main switch 200 is provided as a main-power-supply switch. The main switch 200 is an example embodiment that corresponds to a "change-over switch" in the present teachings.

When the main switch 200 has been switched to the ON state, as shown in FIG. 3, the driving piston 123 is positioned at a final-end position (the left-end position in FIG. 3); furthermore, the state in which the compression piston 133 is positioned at a lowermost-end position (bottom dead center) is defined as the initial position. That is, the initial state is when the crank angle is 0° (bottom dead center).

As shown in FIG. 3, the nailer 100 comprises a magnetic sensor 150. The magnetic sensor 150 principally comprises a magnet 151 and a Hall-effect device 152. The magnet 151 is provided on the crankshaft 115*a*. Moreover, the Hall-effect device 152 is provided at a position of the compression-apparatus-housing part 101B opposing the magnet 151. The Hall-effect device 152 is electrically connected to the battery pack 110 via the control apparatus 109. The Hall-effect device 152 detects the position of the crankshaft 115*a*, and the control apparatus 109 defines as the initial state the state in which the compression piston 133 is positioned at the bottom dead center.

Starting from the initial state shown in FIG. 3, when the user intends to perform an operation to drive a nail and thereby presses the driver guide 141 against the workpiece, which changes the contact-arm switch 143 (refer to FIG. 6) to the ON state, and pulls the trigger 103*a*, which switches the trigger switch 103*b* to the ON state, the electric motor 111 is energized and driven. Thereby, the crank mechanism 115 is driven via the speed-reducing mechanism 113, and the compression piston 133 moves upward. At this time, because the solenoid valve 137 closes the air passage 135, the air inside the compression chamber 131*a* is compressed by the movement of the compression piston 133.

When the magnetic sensor 150 detects that the position of the compression piston 133 is an uppermost-end position (top dead center), which is a crank angle of 180°, the control apparatus 109 controls the electromagnet 138 so as to move the solenoid valve 137 rearward. That is, when the compressed air inside the compression chamber 131*a* has reached its maximum compression state, the solenoid valve 137 opens. Thereby, the annular groove 121*c* communicates with the cylinder chamber 121*a*, and the compressed air inside the compression chamber 131*a* is supplied into the cylinder chamber 121*a* via the air passage 135. When the compressed air is supplied into the cylinder chamber 121*a*, the driving piston 123 is moved forward by the action of the air spring produced by the compressed air, as shown in FIG. 7. Furthermore, the driver 125 of the driving piston 123, which has moved forward, strikes the nail that is standing by in the driving passage 141*a* (refer to FIG. 3). Thereby, a driving operation is performed in which one nail is driven.

Figure 8:
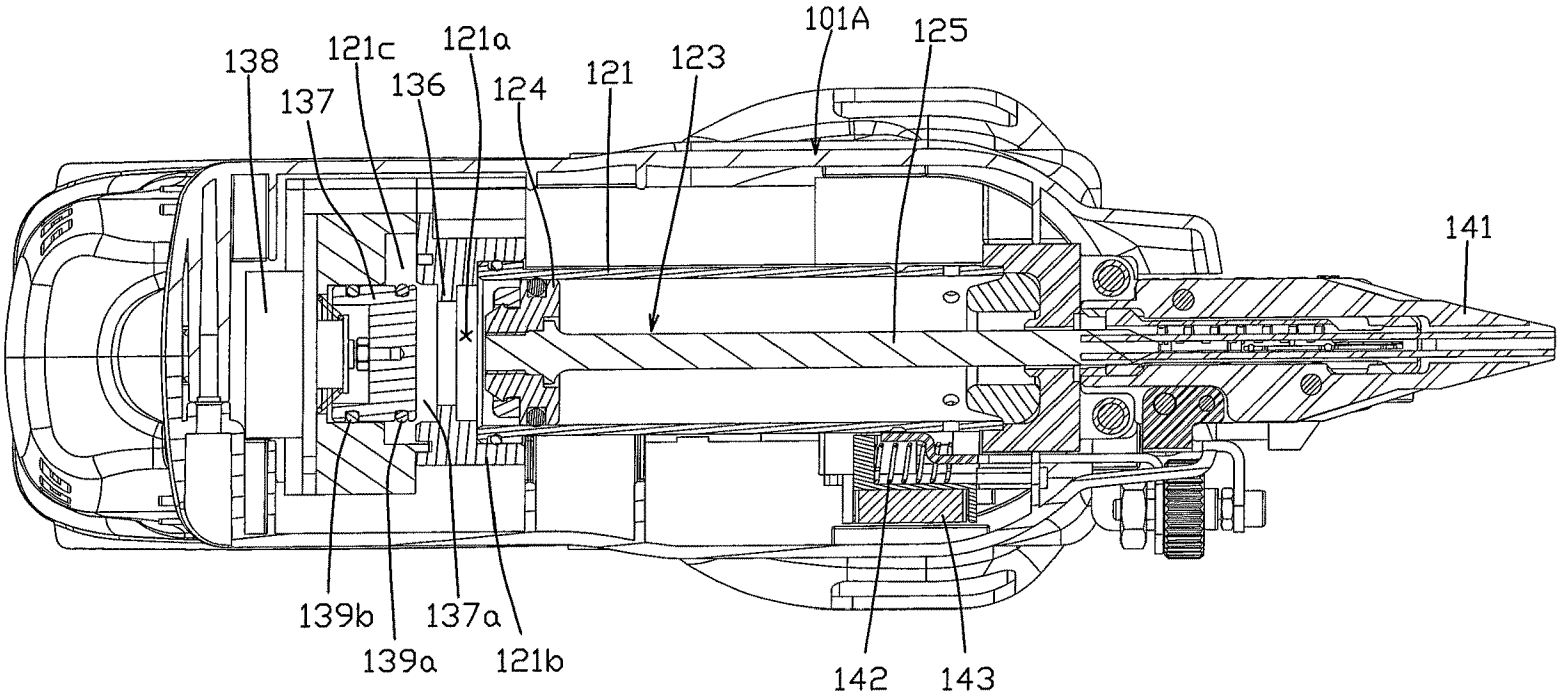
FIG. 8 shows the state in which the open state of the valve is maintained and the driving piston has returned nearly to the rearward initial position shown in FIG. 6.

After the driving operation, the compression piston 133 moves toward the bottom dead center. At that time, the volume of the compression chamber 131*a* increases and the air pressure inside the compression chamber 131*a* becomes a negative pressure that is lower than atmospheric pressure. The negative pressure that arose inside the compression chamber 131*a* acts on the driving piston 123 via the air passage 135 and the cylinder chamber 121*a*. Thereby, as shown in FIG. 8, the driving piston 123 is suctioned and is moved rearward. Furthermore, the driving piston 123 makes contact with the stopper 136 and is positioned at the initial position. When the magnetic sensor 150 detects that the position of the compression piston 133 is the bottom dead center, which is a crank angle of 0°, the control apparatus 109 controls the electromagnet 138 so as to move the solenoid valve 137 forward. Thereby, the air passage 135 closes. Furthermore, when the compression piston 133 returns to the initial position, the supply of electric current to the electric motor 111 is cut off, and the electric motor 111 is stopped. Thus, one cycle of the driving operation ends. Furthermore, during the driving operation, the LED 107 illuminates (irradiates) the tip area of the driver guide 141.

In case that the trigger switch 103*b* is maintained in the ON state after the compression piston 133 has returned to the initial position, the driving tool is configured such that another driving operation is performed by resetting the contact-arm switch 143, which had changed to the OFF state, to the ON state. That is, while the trigger 103*a* remains the state in which it is actuated, one nail is driven each time the driver guide 141 is (repeatedly) pressed against the workpiece. Thereby, a continuous driving operation can be performed, in which nails are consecutively driven while the user continuously holds the trigger 103*a* in the ON state. Furthermore, the driving tool is also configured such that, if the contact-arm switch 143 is maintained in the ON state after a nail has been driven, another driving operation is not performed even if the trigger 103*a* is operated (squeezed) again and the ON/OFF state of the trigger switch 103*b* switches.

The above-mentioned nailer 100 is configured such that a nail is driven when both switches, that is, the trigger switch 103*b* and the contact-arm switch 143, change to the ON state. In other words, the trigger switch 103*b* and the contact-arm switch 143 function as a safety apparatus that prevents a nail from being unintentionally driven as a result of incorrect operation by the user or the like. Accordingly, the trigger switch 103*b* and the contact-arm switch 143 need to operate normally. Consequently, in the present embodiment, it is detected in the driving operation whether the trigger switch 103*b* and the contact-arm switch 143, which are actuated based on user operations, are operating normally. Furthermore, if either of the switches is not operating normally, then the control apparatus 109 inhibits (prevents) the driving of a nail. That is, the unintentional driving of a nail is inhibited (prevent) in the state in which one or both of the switches is (are) not operating normally.

The trigger switch 103*b* is in a normally operating state (a normal state) if the trigger switch 103*b* is in the OFF state when the trigger 103*a* is positioned on the front side, at which the trigger 103*a* is not being operated by the user, and in the ON state when the trigger 103*a* is positioned on the rear side, at which the trigger 103*a* is being operated by the user. Accordingly, if the trigger switch 103*b* is in the ON state in spite of the fact that the trigger 103*a* is positioned on the front side, at which the trigger 103*a* is not being operated by the user, then the trigger switch 103*b* is not operating normally. That is, the trigger switch 103*b* is in an abnormal state.

Likewise, the contact-arm switch 143 is in a normally operating state (a normal state) if the contact-arm switch 143 is in the OFF state when the driver guide 141 is positioned forward and in the ON state when, owing to a user operation during a driving operation, the driver guide 141 is pressed against the workpiece and is positioned rearward. Accordingly, the contact-arm switch 143 is not operating normally if the contact-arm switch 143 is in the ON state in spite of the fact that the driver guide 141 is not pressed against the workpiece and consequently is positioned forward. That is, the contact-arm switch 143 is in an abnormal state.

Consequently, the present embodiment is configured such that the control apparatus 109 detects, at a prescribed timing, whether the trigger switch 103*b* and the contact-arm switch 143 are operating normally. That is, if the trigger switch 103*b* is in the ON state when the trigger 103*a* is positioned on the front side, at which the trigger 103*a* is not being operated by the user, or if the contact-arm switch 143 is in the ON state when the driver guide 141 is positioned forward, at which the driver guide 141 is not being pressed against the workpiece, then the control apparatus 109 determines that there is a malfunction in either of the switches or in the element that actuates either of the switches. In this case, the control apparatus 109 inhibits the subsequent driving of nails. That is, the control apparatus 109 inhibits (cuts off) the supply of electric current to the electric motor 111.

In the nailer 100, the above-mentioned prescribed timings are defined as the time when the user mounts the battery pack 110 and/or the time when the user switches the main (power) switch 200 to the ON state. That is, the time when the battery pack 110 is mounted and the time when the main switch 200 is switched to the ON state are points in time prior to the user using the nailer 100 to perform a driving operation. At such points in time, the user is normally not operating the trigger 103*a*, pressing the driver guide 141 against the workpiece, or the like. In other words, the trigger 103*a* is positioned on the front side, at which the trigger 103*a* is not being operated, and the driver guide 141 is positioned forward, at which the driver guide 141 is not pressed against the workpiece. Accordingly, if the trigger switch 103*b* and the contact-arm switch 143 are in the normal state, then each switch is in the OFF state.

If either switch, that is, the trigger switch 103*b* or the contact-arm switch 143, is in the ON state when the user mounts the battery pack 110 and/or when the user switches the main switch 200 to the ON state, then it can be determined that there is a malfunction in the switch or in an element that actuates the switch. Accordingly, the control apparatus 109 inhibits the subsequent driving of nails. As a result, it is possible to prevent the unintentional driving of a nail.

In addition, in the continuous driving operation, the trigger switch 103*b* is maintained (held) in the ON state; however, if a prescribed time has elapsed without the ON/OFF state of the contact-arm switch 143 being switched, then the control apparatus 109 inhibits the subsequent driving of nails. That is, if the user is not performing a driving operation in spite of it being in continuous driving operation, then the control apparatus 109 determines that it is not in continuous driving operation. That is, the user operation is determined to be a misoperation. Accordingly, the control apparatus 109 cuts off the supply of electric current to the electric motor 111, thereby inhibiting the further driving of nails. Furthermore, in this case, if the trigger switch 103*b* is subsequently switched to the OFF state, then the control apparatus 109 cancels the inhibition of the driving of nails. The above-mentioned prescribed time is set to, for example, five seconds.

If the control apparatus 109 inhibits the driving of nails, then the control apparatus 109 causes the LED 107, 108 to be turned ON. Thereby, the drive of the electric motor 111 is stopped and the fact that the driving of nails is being inhibited is reported/indicated to the user. Furthermore, the control apparatus 109 may not only turn the LEDs 107, 108 ON but may also flash them ON and OFF. In addition, the control apparatus 109 may be configured so as to change the color of the lights generated by the LEDs 107, 108. In addition, it may be configured so as to turn ON or flash ON/OFF just one of the LEDs 107, 108.

According to the embodiment described above, the driving of nails is inhibited (prevented) if a malfunction is detected in either of the switches, that is, the trigger switch 103*b* or the contact-arm switch 143. Thereby, in the state in which there is a malfunction in the trigger switch 103*b*, the contact-arm switch 143, or the like, nails are prevented from being unintentionally driven.

In addition, according to the present embodiment, the fact that there is a malfunction in the trigger switch 103*b*, the contact-arm switch 143, or either of the elements, that is, in the trigger 103*a* that actuates the trigger switch 103*b* or in the driver guide 141 that actuates the contact-arm switch 143, is detected.

In addition, according to the present embodiment, the control apparatus 109 inhibits the driving of nails based on the ON/OFF state of the trigger switch 103*b* and the contact-arm switch 143 when the battery pack 110 is mounted, when the main switch 200 is switched to the ON state, and the like. Consequently, the driving of nails can be inhibited without detecting the position of the trigger 103*a* that actuates the trigger switch 103*b*, the position of the driver guide 141 that actuates the contact-arm switch 143, and the like.

In addition, according to the present embodiment, in the continuous driving operation, if the user absently (inadvertently) operates (squeezes) the trigger 103*a* continuously for a long time, then the subsequent driving of nails is inhibited, and thereby the driving of a nail due to the inattention or incorrect operation by the user, or the like, is prevented.

In addition, according to the present embodiment, the fact that the driving of nails is being inhibited can be reported/indicated by the LEDs 107, 108. That is, the user can ascertain, by viewing the LEDs 107, 108, that a malfunction has been detected in the nailer 100.

In the above, the control apparatus 109 is configured to detect whether the trigger switch 103*b* and the contact-arm switch 143 are operating normally when the user mounts the battery pack 110 and/or when the user switches the main switch 200 to the ON state, but it is not limited thereto. For example, the control apparatus 109 may be configured such that it is capable of always detecting whether the trigger switch 103*b* and contact-arm switch 143 are operating normally. That is, the control apparatus 109 may be configured such that sensors that detect the position of the trigger 103*a* and the position of the driver guide 141, respectively, are provided, and the control apparatus 109 detects whether the trigger switch 103*b* and the contact-arm switch 143 are operating normally based on the relationship between the positions of the trigger 103*a* and the driver guide 141 and the ON/OFF states of the trigger switch 103*b* and the contact-arm switch 143.

In addition, in the above, when the battery pack 110 is mounted, when the main switch 200 is switched to the ON state, or the like, the user normally is not operating the trigger 103*a* and the driver guide 141 is normally not pressed against the workpiece; consequently, if either of the switches, that is, the trigger switch 103*b* or the contact-arm switch 143, is in the ON state, then it is determined that the switch is in an abnormal state, but it is not limited thereto. For example, depending on the state in which the nailer 100 is situated, it is possible that the trigger 103*a*, the driver guide 141, or the like is being operated even though the user is mounting the battery pack 110 and/or the user is switching the main switch 200 to the ON state. In addition, there is also the possibility of a case in which a malfunction occurs in the trigger 103*a*, the driver guide 141, or the like, and thereby the trigger 103*a*, the driver guide 141, or the like is not positioned at a position at which it is not being operated. Consequently, the driving tool may be configured such that, when the user mounts the battery pack 110 and/or when the user switches the main switch 200 to the ON state, the control apparatus 109 inhibits (prevents) the driving of nails if either of the switches, that is, the trigger switch 103*b* or the contact-arm switch 143, is in the ON state, regardless of the state of the nailer 100. That is, at the above-mentioned prescribed timings, regardless of the position of the trigger 103*a* and/or the position of the driver guide 141, the case in which either of the switches, that is, the trigger switch 103*b* or the contact-arm switch 143, is in the ON state may be regarded as an abnormal state. In the case of an abnormal state, the control apparatus 109 inhibits the driving of nails. Furthermore, in this case, the driving tool is configured such that, if the trigger switch 103*b* and the contact-arm switch 143 subsequently change to the OFF state, then the control apparatus 109 permits the subsequent driving of nails.

In addition, in the above, the LEDs 107, 108 are provided as informing means, but there may be just one LED. In addition, a buzzer that generates sound, an actuator that generates vibrations, or the like may be provided as the informing means.

In addition, in the above, the battery pack 110 is configured in an attachable and detachable manner, but it is not limited thereto. The battery pack 110 may be fixed to the nailer 100 as long as it is rechargably configured.

Taking into consideration the above objects of the present teachings, the following aspects of the driving tool according to the present teachings can be configured.

(Aspect 1)

A driving tool that drives a driven article (fastener) out of an ejection port, comprising:

a cylinder;

a piston capable of sliding within the cylinder;

a motor that drives the piston;

a controller that controls the motor;

a first movable member that, based on a user operation performed when the user drives the driven article, makes contact with a workpiece and thereby is moved from a first position to a second position;

a first switch configured such that it is in an OFF state if the first movable member is positioned at the first position and in an ON state if the first movable member is positioned at the second position;

a second movable member that is operated by the user when the user drives the driven article and thereby is moved from a third position to a fourth position; and a second switch configured such that it is in the OFF state if the second movable member is positioned at the third position and in the ON state if the second movable member is positioned at the fourth position;

wherein, a battery for supplying electric current to the motor is configured such that the battery is attachable;

the controller is configured to, if both the first switch and the second switch change to the ON state, generate an air pressure change inside the cylinder by driving the motor and thereby drive the driven article by the pressure change;

the battery is configured such that it is attachable to and detachable from the driving tool; and the controller is configured to inhibit the driving of the driven article in the case in which it is detected that at least one of the switches among the first switch and the second switch is in the ON state when the battery is mounted.

(Aspect 2)

A driving tool that drives a driven article from an ejection port, comprising:

a cylinder;

a piston capable of sliding within the cylinder;

a motor that drives the piston;

a controller that controls the motor;

a first movable member that, based on a user operation performed when the user drives the driven article, makes contact with a workpiece and thereby is moved from a first position to a second position;

a first switch configured such that it is in an OFF state if the first movable member is positioned at the first position and in an ON state if the first movable member is positioned at the second position;

a second movable member that is operated by the user when the user drives the driven article and thereby is moved from a third position to a fourth position; and a second switch configured such that it is in the OFF state if the second movable member is positioned at the third position and in the ON state if the second movable member is positioned at the fourth position;

wherein, a battery for supplying electric current to the motor is configured such that the battery is attachable;

the controller is configured to, if both the first switch and the second switch change to the ON state, generate an air pressure change inside the cylinder by driving the motor and thereby drive the driven article by the pressure change;

comprising:

a change-over switch that switches between an electric-current-supply permitted state that permits the supply of electric current from the battery to the controller and an electric-current-supply cutoff state that cuts off the supply of electric current;

wherein, the controller is configured to inhibit the driving of the driven article if it is detected that at least one of the switches among the first switch and the second switch is in the ON state when the change-over switch is switched from the electric-current-supply cutoff state to the electric-current-supply permitted state.

(Aspect 3)

The driving tool according to aspects 1 or 2, wherein the controller is configured to permit the subsequent driving of the driven article if it is detected that the first switch is in the OFF state and if it is detected that the second switch is in the OFF state.

(Aspect 4)

The driving tool according to any one of claims 1-8 or aspects 1-3, wherein the first movable member is a contact arm that, based on a user operation, makes contact with the workpiece and thereby is moved; and the second movable member is a trigger that is directly operated by a finger of the user.

EXPLANATION OF THE REFERENCE NUMBERS

100 Nailer

101 Main-body housing

101A Driving-mechanism-housing part
101B Compression-apparatus-housing part
101C Motor-housing part
102 Inner-side housing
103 Handle part
103*a* Trigger
103*b* Trigger switch
105 Magazine
105*a* Pusher plate
107 LED
108 LED
109 Control apparatus
110 Battery pack
111 Electric motor
113 Speed-reducing mechanism
115 Crank mechanism
115*a* Crankshaft
115*b* Eccentric pin
115*c* Connecting rod
120 Nail-driving mechanism
121 Driving cylinder
121*a* Cylinder chamber
121*b* Cylinder head
121*c* Annular groove
123 Driving piston
124 Piston-main-body part
125 Driver
130 Compression apparatus
131 Compression cylinder
131*a* Compression chamber
131*b* Cylinder head
133 Compression piston
135 Air passage
135*a* Communication port
135*b* Communication port
135*c* Communication path
136 Stopper
137 Solenoid valve
137*a* Valve chamber
138 Electromagnet
139*a* O-ring
139*b* O-ring
141 Driver guide
141*a* Driving passage
142 Biasing spring
143 Contact-arm switch
150 Magnetic sensor
151 Magnet
152 Hall-effect device
200 Main switch

The invention claimed is:

1. A driving tool configured to drive a driven article out of an ejection port, comprising:

a cylinder;

a piston slidably housed within the cylinder;

a motor configured to drive the piston;

a controller configured to control operation of the motor;

a first movable member configured to be moved from a first position to a second position by a user pressing the first movable member against a workpiece in order to drive the driven article into the workpiece;

a first switch configured to be in an OFF state when the first movable member is positioned at the first position and in an ON state when the first movable member is positioned at the second position;

a second movable member configured to be moved from a third position to a fourth position by the user in order to initiate a driving operation; and a second switch configured to be in the OFF state when the second movable member is positioned at the third position and in the ON state when the second movable member is positioned at the fourth position;

wherein, the driving tool is configured to detachably mount a battery for supplying electric current to the motor;

the controller is configured to, if both the first switch and the second switch change to the ON state, generate an air pressure change inside the cylinder by driving the motor and thereby drive the driven article as a result of the pressure change; and the controller is configured to prevent the motor from driving the piston and thus preventing the driven article from being driven when one of the following states is detected:

the first switch is in the ON state while the first movable member is positioned at the first position; or the second switch is in the ON state while the second movable member is positioned at the third position.

2. The driving tool according to claim 1, wherein the controller is configured to prevent the driving of the driven article when it is detected that the first switch and/or the second switch is in the ON state at the time that the battery is mounted.

3. The driving tool according to claim 2, further comprising:

a change-over switch configured to switch between an electric-current-supply permitted state that permits the supply of electric current from the battery to the controller and an electric-current-supply cutoff state that cuts off the supply of electric current;

wherein, the controller is configured to prevent the driving of the driven article when it is detected that the first switch and/or the second switch is in the ON state at the time that the change-over switch is switched from the electric-current-supply cutoff state to the electric-current-supply permitted state.

4. The driving tool according to claim 3, wherein the controller is configured to prevent the driving of the driven article when it is detected that:

the first switch is in the ON state continuously for the first predetermined period of time while the first movable member is positioned at the second position or the second switch is in the ON state continuously for the second predetermined period of time while the second movable member is positioned at the fourth position.

5. The driving tool according to claim 4, wherein the first movable member is a contact arm configured to contact the workpiece and be moved from the first position to the second position when the user presses the driving tool against the workpiece; and the second movable member is a finger-operable trigger.

6. The driving tool according to claim 1, further comprising:

a change-over switch configured to switch between an electric-current-supply permitted state that permits the supply of electric current from the battery to the controller and an electric-current-supply cutoff state that cuts off the supply of electric current;

wherein, the controller is configured to prevent the driving of the driven article when it is detected that the first switch and/or the second switch is in the ON state at the time that the change-over switch is switched from the electric-current-supply cutoff state to the electric-current-supply permitted state.

7. The driving tool according to claim 1, wherein the controller is configured to prevent the driving of the driven article when it is detected that:

the first switch is in the ON state continuously for the first predetermined period of time while the first movable member is positioned at the second position or the second switch is in the ON state continuously for the second predetermined period of time while the second movable member is positioned at the fourth position.

8. The driving tool according to claim 1, wherein the controller is configured to prevent the driving of the driven article when it is detected that:

the first switch is in the ON state continuously for the first predetermined period of time while the first movable member is positioned at the second position or the second switch is in the ON state continuously for the second predetermined period of time while the second movable member is positioned at the fourth position.

9. The driving tool according to claim 1, comprising:

an informing means for indicating to the user that the driving of the driven article is being prevented by the controller.

10. The driving tool according to claim 1, wherein the first movable member is a contact arm configured to contact the workpiece and be moved from the first position to the second position when the user presses the driving tool against the workpiece; and the second movable member is a trigger configured to be directly operated by a finger of the user.

11. A driving tool comprising:

a first movable element configured to be movable from a first position to a second position when a user presses the first movable member against a workpiece in order to drive a driven article into the workpiece;

a first switch configured to be normally in an OFF state when the first movable member is positioned at the first position and switched to an ON state when the first movable member is moved to the second position;

a second movable member configured to be movable from a third position to a fourth position by the user in order to initiate a driving operation;

a second switch configured to be normally in an OFF state when the second movable member is positioned at the third position and switched to an ON state when the second movable member is moved to the fourth position; and a controller configured to prevent the driving operation when one of the following states is detected:

(i) the first switch is in the ON state while the first movable member is positioned at the first position; or (ii) the second switch is in the ON state while the second movable member is positioned at the third position.

12. The driving tool according to claim 11, wherein:

the first movable member is a contact arm configured to contact the workpiece and be moved from the first position to the second position when the user presses the driving tool against the workpiece;

the second movable member is a finger-operable trigger;

a piston is slidably housed within a cylinder a motor is configured to drive the piston and the controller is configured to:

detect when the first switch and the second switch are both switched to the ON states, and in response thereto, drive the motor to generate an air pressure change inside the cylinder in order to drive the driven article into the workpiece, detect states (i) and (ii) when a detachable battery is electrically coupled to the driving tool.

13. A method of operating a driving tool, wherein the driving tool comprises:

a first movable element configured to be movable from a first position to a second position when a user presses the first movable member against a workpiece in order to drive a driven article into the workpiece;

a first switch configured to be normally in an OFF state when the first movable member is positioned at the first position and switched to an ON state when the first movable member is moved to the second position;

a second movable member configured to be movable from a third position to a fourth position by the user in order to initiate a driving operation; and a second switch configured to be normally in an OFF state when the second movable member is positioned at the third position and switched to an ON state when the second movable member is moved to the fourth position;

the method comprising:

preventing the driving operation when one of the following states is detected:

(i) the first switch is in the ON state while the first movable member is positioned at the first position; or (ii) the second switch is in the ON state while the second movable member is positioned at the third position.

14. The method according to claim 13, wherein the states (i) and (ii) are detected when a main power switch of the driving tool is switched from an OFF state to an ON state.

15. The method according to claim 13, wherein the states (i) and (ii) are detected when a detachable battery is electrically coupled to the driving tool.

16. The method according to claim 15, wherein the first movable member is a contact arm configured to contact the workpiece and be moved from the first position to the second position when the user presses the driving tool against the workpiece; and the second movable member is a finger-operable trigger.

17. The method according to claim 16, wherein the driving tool further comprises a piston slidably housed within a cylinder and a motor that drives the piston and the method further comprises:

detecting when the first switch and the second switch are both switched to the ON states, and in response thereto, driving the motor to generate an air pressure change inside the cylinder in order to drive the driven article into the workpiece.

* * * * *